US005951352A

United States Patent [19]

Branovich et al.

[11] Patent Number: 5,951,352

[45] Date of Patent: Sep. 14, 1999

[54] METHODS OF MAKING THERMIONIC CATHODE USING OXYGEN DEFICIENT AND FULLY OXIDIZED MATERIAL TO ENHANCE EMISSIONS

[75] Inventors: Louis E. Branovich, Howell; Donald W. Eckart, Wall; Paul Fischer, Oakhurst, all of N.J.

[73] Assignee: The United States of America as represented by the Secretary of the Army, Washington, D.C.

[21] Appl. No.: 09/012,346

[22] Filed: Jan. 23, 1998

Related U.S. Application Data

[60] Division of application No. 08/647,502, May 14, 1996, Pat. No. 5,828,164, which is a continuation-in-part of application No. 08/218,533, Mar. 28, 1994, abandoned, which is a continuation-in-part of application No. 07/866,773, Apr. 3, 1992, Pat. No. 5,298,830.

[51] Int. Cl.[6] ..... H01J 9/04

[52] U.S. Cl. ..... 445/51

[58] Field of Search ..... 445/51

[56] References Cited

U.S. PATENT DOCUMENTS 5,132,081 7/1992 Lee ..... 445/51

*Primary Examiner*—Kenneth J. Ramsey
*Attorney, Agent, or Firm*—Michael Zelenka; George B. Tereschuk

[57] ABSTRACT

A method is provided of preparing an impregnated cathode with enhanced thermionic emission from a porous billet by impregnating the billed with a suitable impregnant in the presence of an oxygen deficient compound. Additives such as Ir, Os, and Rh react in such a way as to increase emission by reacting to generate oxygen deficient compounds such as $WO_2$. Moreover, intermediate oxygen sufficient products formed in the chemical reactions can be used as impregnants providing they generate oxygen deficient compounds in the presence of the active emissive material.

53 Claims, 4 Drawing Sheets

METHODS OF MAKING THERMIONIC CATHODE USING OXYGEN DEFICIENT AND FULLY OXIDIZED MATERIAL TO ENHANCE EMISSIONS

DIVISIONAL APPLICATION

This application is a divisional application of U.S. patent application Ser. No. 08/647,502 filed on May 14, 1996, which was allowed and issued as U.S. Pat. No. 5,828,164, which was a continuation in part of U.S. Patent and Trademark Office application No. 08/218,533, now abandoned, originally entitled, "Improved Thermionic Cathode and Method of Making Same," filed on Mar. 28, 1994, which title was amended to "Improved Thermionic Cathode Using Oxygen Deficient and Fully Oxidized Material to Enhance Emissions." That application is a continuation in part of U.S. Patent and Trademark Office application No. 07/866,773, entitled, "Method of Preparing an Impregnated Cathode with an Enhanced Thermionic Emission from a Porous Billet and Cathode so Prepared," filed Apr. 3, 1992, and issued as U.S. Pat. No. 5,298,830 on Mar. 29, 1994. This divisional application is being filed under 37 C.F.R. §1.53 and priority from U.S. Patent and Trademark Office application No. 07/866,773 is hereby claimed.

GOVERNMENT INTEREST

The invention described herein may be manufactured, used, and licensed by or for the Government of the United States of America without the payment to us of any royalty thereon.

FIELD OF INVENTION

This invention relates in general to improved thermionic cathodes using oxygen deficient and fully oxidized materials to enhance thermionic emissions, as well as methods of preparing an impregnated cathode with enhanced thermionic emission from a porous billet, in particular, to such cathodes and methods wherein the impregnation is made in the presence of an oxygen deficient compound, and more particularly, to cathodes and methods in which the ratio of oxygen deficient compounds, fully oxidized compounds, and active emissive metals and metal oxides are combined in such a way that optimizes emissions. The thermal emission of electrons, known as thermionic emission, where an electron current leaves the surface of a material due to thermal activation, is of particular interest in the cathodes and methods of the present invention.

BACKGROUND OF THE INVENTION

Heretofore, it has been known that electron emission could be obtained from a porous billet, as for example a porous tungsten billet that had been impregnated with a barium containing compound such as $Ba_3Al_2O_6$. The $Ba_3Al_2O_6$ impregnate reacts with the wall of the porous tungsten billet generating free barium. The free barium then migrates to the surface by Knudsen flow to give electron emission.

Specific examples of cathodes formed by this general model are described in several U.S. Patents issued to some of the inventors herein. The following is a list of some of these U.S. Patents, all of which are incorporated herein by reference: U.S. Pat. No. 5,114,742, entitled, "Method of Preparing an Improved Scandate Cathode;" U.S. Pat. No. 5,074,818, entitled, "Improved Scandate Cathode;" U.S. Pat. No. 4,895,699, entitled, "Barium Peroxide, Iridium and Excess Tungsten as Impregnants for Cathodes;" U.S. Pat. No. 4,840,767, entitled, "Method of Making a Cathode from Tungsten and Iridium Powders Using a Barium Iridiate Formed from Barium Peroxide and Iridium Oxide as the Impregnant;" and U.S. Pat. No. 4,818,480, entitled, "Method of Making Oxyanion using $BaO_2$ with Ir and Os or Rh for Cathode Impregnation." These types of cathodes have several uses in vacuum electronic devices that employ thermionic cathodes. These uses include: microwave/millimeter wave tubes, high-speed/high current switches, linear accelerators, X-ray generators for medical and industrial diagnostics, and high power terahertz (infrared) or rf sources.

Other types of cathodes, such as oxide coated cathodes used primarily in televisions, have been disclosed in other U.S. Patents, such as U.S. Pat. No. 4,855,637 issued to Watanabe et al. on May 8, 1990 and entitled, "Cathode for Electron Tube," and U.S. Pat. No. 5,118,984 issued to Saito et al. on Jun. 2, 1992 and entitled, "Electron Cathode Tube." Although these U.S. Patents describe specific embodiments of cathodes, in the Background of these patents, it is generally disclosed that as a result of the reactions of BaO and Si and BaO and MgO, a part of the alkali earth metal oxides, which are formed on the base, are reduced to be an oxygen deficient semiconductor, which facilitates electron emission. These patents further disclose that such cathodes have a current density of 1.32 to 2.64 $A/cm^2$ at a temperature of 700° C. to 800° C. Despite these results, it is still desired in the cathode arts to attain an electron emission having a current density which is still higher than that current density disclosed by all the above listed U.S. Patents while being able to be operated at lower temperatures.

SUMMARY OF THE INVENTION

Accordingly, this invention provides a cathode having an optimized emission, faster start up time, lower operating temperature, and a longer life, as well as methods of making a cathode having those attributes.

The foregoing can be attained by impregnating a porous billet in the presence of an oxygen deficient compound or by manipulating the resultant stoichiometry and ratio of the quantity of oxygen deficient materials, for example, $WO_2$ or n-type semiconductor material, with fully oxidized materials, for example $WO_3$, and with active emissive materials, for example Ba or BaO, such that the electron emission is optimized after formation of the cathode. As described more fully below, this ratio is based upon known principles of the n- and p-type semiconductors, the introduction of impurities through doping and electron transfer between a fully oxidized compound and an oxygen deficient compound. By manipulating this ratio, particularly with respect to the oxygen deficient materials and fully oxidized materials, the emission of the cathode can be greatly enhanced and the operating temperature can be lowered, thereby prolonging the life of the cathode. It is theorized that the oxygen deficient compounds are similar in crystalline structure to superconductor deficient oxides and that reactions similar to those in known semiconductors such as gallium arsenide take place therefore, the generation of electrons is controlled by this element of the cathode.

The oxygen deficient material or compounds disclosed herein are considered as any material or compound in which a site is available for an oxygen atom but not occupied by an oxygen atom and thus, the valence of the remaining metals drops to a lower valence state. Examples of oxygen deficient compounds include, $ScWO_4$, $AlWO_4$, $MoO_2$, $WO_2$ and mixed oxides of rhenium and iridium. Oxygen deficient compounds are also considered to include the similar terms "dopant acceptor" and "p-type semiconductor" found in the literature.

In accordance with the present invention, however, these materials do not have to be oxygen deficient; they only must exhibit the properties of oxygen deficient materials, that is, a lowered valence. For example, sulfur could be substituted for the oxygen in such compounds to create the same effect. Therefore, any metallic compound that has dropped in valence due to an unoccupied site for a potential bond may be used in the cathodes and methods of the present invention. Accordingly whenever the term "oxygen deficient" is used throughout this disclosure and the appended claims it will be considered to refer to any material or compound that has a lowered valence state, and the term is merely used for explanation purposes and therefore, is not intended to limit the scope of this disclosure and the appended claims.

The term "fully oxidized" material or compound is considered as any material or compound that has no available electron spaces for a reaction, and is also known by the terms "oxygen sufficient," "donor dopant" and "n-type semiconductor" used in the literature. This is the opposite of an oxygen deficient material or compound which has electron spaces available for a reaction. Whenever "fully oxidized" is used throughout this disclosure and the appended claims it will be considered to refer to any material or compound that has no available electron spaces for a reaction, but should not otherwise limit the scope of this disclosure and the appended claims.

As those skilled in the art will appreciate, regeneration of the impregnant must occur for the cathodes to have a long life of 80,000 to 200,000 hours. Therefore, oxygen deficient compounds must either be present in the cathode or must be generated or regenerated in the cathode as well. The oxygen deficient compounds, once they,have acquired a negative charge, react with Ba and/or BaO, for example, to form fully oxidized compounds and release electrons that are responsible for electron emission from the cathode, assuming that the cathode is constructed with a semiconductor on the bottom, an active metal on the top and an active metal oxide on the top surface of the cathode. The method of regeneration of the impregnant may best be illustrated by using $Ba_2Al_2O_6$ as an example, which reacts with a tungsten oxide ($WO_2$) to form an unstable intermediate compound, which is oxygen deficient, $Ba_2Al_2O_4$, and releases free Ba. This unstable intermediate compound, $Ba_2Al_2O_4$, in the presence of 2 W, reacts to form 2 Al+2 $WO_2$+2 Ba. This may be expressed in an overall equation as:

$$Ba_3Al_2O_6+3W \rightarrow 3Ba+2Al+3WO_2$$

The 3 Ba+2 Al+3 $WO_2$ then further react with each other to form $Ba_3Al_2O_6$+3 W which are the original starting compounds. In the foregoing equation, said $Ba_3Al_2O_6$ being a fully oxidized compound, and said 3 W, 3 Ba, 2 Al and 3 $WO_2$ being oxygen deficient compounds, said fully oxidized compound having, during emission, an atomic ratio in the order of 1 part per 1,000,000 as compared to said oxygen deficient compounds and said $Ba_3Al_2O_6$ fully oxidized compound having no electron spaces available for a reaction in order to be considered a fully oxidized compound. The overall equation, however, is actually the sum of the following two equations:

$$Ba_3Al_2O_6+W \rightarrow Ba+WO_2+Ba_2Al_2O_4$$

$$Ba_2Al_2O_4+2W \rightarrow 2Ba+2Al+2WO_2$$

In the first of the foregoing equations, said $Ba_3Al_2O_6$ and said $Ba_2Al_2O_4$ being fully oxidized compounds, while said W, Ba, and $WO_2$ being oxygen deficient compounds. In the second of the foregoing equations, said $Ba_2Al_2O_4$ being a fully oxidized compound, while said 2 W, 2 Ba, 2 Al and 2 $WO_2$ being oxygen deficient compounds. In these foregoing equations, said fully oxidized compound having, during emission, an atomic ratio in the order of 1 part per 1,000,000 as compared to said oxygen deficient compounds and said $Ba_3Al_2O_6$, $Ba_2Al_2O_4$ and $Ba_2Al_2O_4$ fully oxidized compounds having no electron spaces available for a reaction in order to be considered fully oxidized compounds.

The present invention relies in part on well-accepted principles of semiconductivity and the effects of introducing a chemical impurity into a system through doping, at a ratio of 1 part impurity per 1,000,000 matrix. The cathodes and methods of the present invention provide similar electron transfer reactions to those which are known to take place with compounds such as gallium arsenide when a 3+ or 5+ metal oxide is added as an impurity through doping at the aforementioned impurity to matrix ratio of 1 part per 1,000,000. FIG. 1 is a chemical structure diagram of gallium arsenide. When, for example, either gallium aluminum, a 3+ metal considered to be an acceptor dopant and a p-type semiconductor, or arsenic antimony, a 5+ metal considered to be donor dopant and an n-type semiconductor, are added as impurities to gallium arsenide, electron movement similar to those achieved in the present invention are realized based upon the oxygen deficient compound gaining electrons from the fully oxidized compound. Since it has been theorized that oxygen deficient compounds such as 3 W, 3 Ba, 2 Al and 3 $WO_2$ have a similar atomic structure to superconductor deficient oxides the atomic ratio of fully oxidized compounds to oxygen deficient compounds is critical in the cathodes and methods of the present invention.

It is known that from examples such as introducing chemical impurities into the gallium arsenide system at a ratio of 1 part per 1,000,000 impurity to matrix that an atomic ratio of 1 part per 1,000,000 is employed based on experience with doping levels. Furthermore, experience with doping levels in other semiconductor applications also indicates that if too much of an oxygen deficient dopant is introduced into a system, the excessive amounts of the oxygen deficient compound will upset the crystalline lattice structure of the system causing excessive electron collisions impeding the electron flow that is desired for useful thermionic emissions to take place. Similarly, it is also known that introducing too little oxygen deficient dopant tends to reduce electron flow so that the cathode becomes an insulator. Therefore, experience teaches that an atomic ratio on the order of 1 part per 1,000,000 will provide the requisite electron exchange to facilitate the desired emission levels and that an appreciably different atomic ratio will not achieve the desired results.

This atomic ratio provides a useful order of magnitude for practicing this invention, but should not otherwise limit the scope of this disclosure and the appended claims as far as other ratios may be employed.

Because the generation of oxygen deficient compounds or similar compounds is critical to the operation of the present invention, their formation is explained below. Specifically, $WO_2$ is formed in the above scheme when a $WO_2$ reacts with the impregnant $Ba_3Al_2O_6$ to remove one oxygen to form $WO_3$ and a $Ba_3Al_2O_5$ molecule, which is also oxygen deficient. (This may be expressed as $3Ba_3Al_2O_6+W \rightarrow 3Ba_3Al_2O_5+WO_3$.) Thereafter, $WO_3$ reacts with the Al to yield $Al_2(WO_4)_3$, which in the presence of W further results in $AlWO_4$ and $WO_2$, which are also both oxygen deficient compounds. (This may be expressed as $4\ WO_3+2Al \rightarrow 2\ WO_2+AlWO_4$.)

Generically, the impregnants of the preferred embodiment of the present invention may be described as $A_xB_yO_z$, where A is a very electropositive metal (more active than B); B is a metal that converts over to its most stable oxide in the presence of an element such as tungsten (W) or other active billet material, e.g. molybdenum (Mo); and O is oxygen. The subscript Z must be such that the valence of A times its subscript is equal to subscript of the oxygen (z) divided by the absolute value of the valence of oxygen (2). The value of the subscript on the oxygen (z) can be one less than this amount if one of the oxygen's are replaced with a pair of electrons. An example would be $Ba_3Al_2O_6$ and $Ba_3Al_2O_5$ (1 pair of electrons is substituted for the oxygen that is attached to the aluminum).

With this preferred impregnant type, the A, which is more active than B, reacts with the B oxide and converts it to a pure metal and the A, in turn, converts to its stable oxide. Then, the active B, in the presence of $WO_3$, reacts to form two oxygen deficient compounds $B_YWO_4$ (where Y=+1) and $WO_2$ in a W billet. When the Ba and BaO generated previously react with the oxygen deficient materials to form fully oxidized materials such as $BaWO_4$ along with Al for example, the materials generated are recycled into the regeneration process to continue the process of electron emission. The only limitation to these various methods of using the preferred impregnate, $A_xB_yO_z$, is that it must be able to form the oxygen deficient compounds and then convert to fully oxidized compounds which are capable of joining the regeneration cycle.

Although using this general formula for an impregnant is the preferred embodiment, various other methods of generating oxygen deficient compounds and their counterparts are also in accordance with the present invention. For example, the oxygen deficient materials, fully oxidized materials and the active emissive materials can simply be combined in a bored out billet and sintered to form the cathode. Or the oxygen deficient and fully oxidized materials can be combined to form a porous billet into which the active emissive material is impregnated and sintered to form the cathode. Similarly, the opposite can also be achieved wherein the active emissive material in its metallic state is formed as a billet and the oxygen deficient and fully oxidized materials are impregnated therein. Other such methods shall be disclosed further in the Detailed Description of the Invention. In summary though, these other methods include the following:

1) Using fully oxidized tungstate or molybdate of B (such as Al or Sc) to react with W. An example of this is:

$$2W+Al_2(WO_4)_3 \rightarrow 2AlWO_4+WO_2$$

2) Forming oxygen deficient materials in various ways as illustrated below:

a) reacting B oxides, B metal and $WO_3$ such as $$Al_2O_3+5Al+9WO_3 \rightarrow 7AlWO_4+WO_2+W$$

b) reacting the B stable oxide ($Al_2O_3$ for example) with $WO_3$ and $WO_2$ as shown by:

$$Al_2O_3+WO_2+WO_3 \rightarrow 2AlWO_4$$

or $$Al_2(WO_4)_3+Al \rightarrow 3AlWO_4.$$

c) adding, in predetermined molar ratios, other oxygen deficient compounds, such as $WO_2$, $ScWO_4$, $MoO_2$, which are formed as other intermediate products such as free Al, free Sc, oxides such as $Sc_2O_3$, $Al_2O_3$ and $WO_3$ to further help in the formation of oxygen deficient compounds.

3) Combining pulverized pieces of alloys, such as low melting point metals, in molar ratio suitable for maximum emission with materials for maximum electron emission.

4) Using an W or W-Al alloy or similar alloy, such as W-Ir, W-Os, etc, for the porous billet.

5) Using a top layering of emissive or emissive enhancing material, such as Iridium or using a top layering of an oxygen deficient material.

Therefore, the cathode, as described herein, includes combining an oxygen deficient compound and a fully oxidized compound wherein a predetermined atomic ratio of fully oxidized compound to oxygen deficient compound can be set, as desired, to enhance the emissions of the cathode. As a result, the cathode can be formed from impregnating a billet with the oxygen deficient and fully oxidized material, or by depositing a layer of emissive material upon a surface of an impregnated billet or upon a layer-type cathode, wherein the emissive material is composed of a predetermined ratio of fully oxidized material to oxygen deficient material, so that the fully oxidized compound has, during emission, an atomic ratio in the order of 1 part per 1,000,000 as compared to the oxygen deficient compound, said fully oxidized compounds having no electron spaces available for a reaction in order to be considered fully oxidized compounds. As a result, the top layering forms an enhanced active region of the cathode. It should be noted, however, that the impregnated billet-type cathode does not necessarily require a top layering to enhance emissions as long as the impregnant is composed of the oxygen deficient and fully oxidized material in a ratio that enhances emissions of the cathode.

BRIEF DESCRIPTION OF THE DRAWINGS

These and other features of the invention will become apparent in light of the following Detailed Description of the Invention and the attached Figures wherein.

DETAILED DESCRIPTION OF THE INVENTION

Since, according to the present invention, the emission of the cathode depends upon the formation of oxygen deficient compounds and the atomic ratio of the fully oxidized compounds to oxygen deficient compounds and the emissive material, the present invention provides cathodes and methods to maximize emission can be obtained by doing one of the following: (1) Adding the oxygen deficient compounds to the impregnant; (2) Adding compounds, such as $Al_2$ $(WO_4)_3$ or $Sc_2(WO_4)_3$, which in the presence of W react to form oxygen deficient compounds, such as $WO_2$ and $AlWO_4$ or $ScWO_4$; (3) Adding composites of 1 and 2 above; (4) forming the cathode directly from a mixture of oxygen deficient and fully oxidized materials and an emissive material; (5) layering the top of the cathode with or adding emission enhancing materials, such as Iridium, to the impregnant or mixture of (4); or (6) altering the billet material itself.

Figure 1:
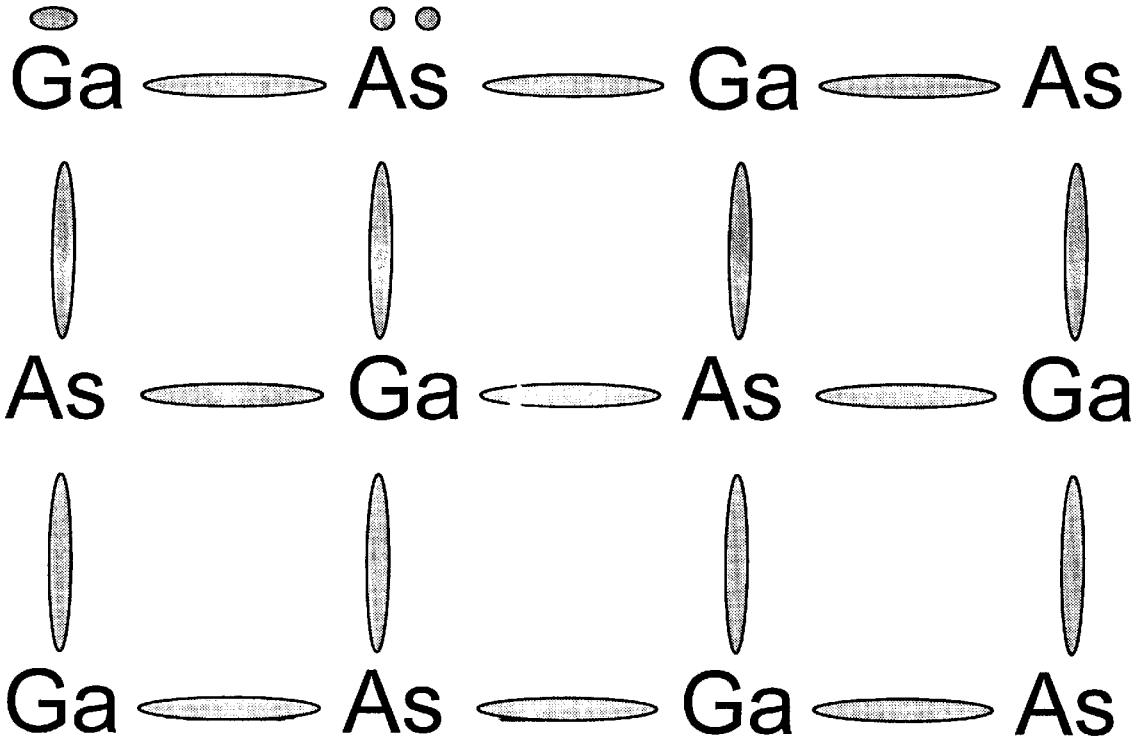
FIG. 1 is a chemical structure diagram of gallium arsenide.

Referring now to the drawings, FIG. 1 is a chemical structure diagram of gallium arsenide which is useful to illustrate the chemical structure allowing electron transfer reactions similar to those taking place in the cathodes and methods of the present invention when in the gallium arsenide example a 3+ or 5+ metal oxide is added as an impurity through doping. When either gallium aluminum, a 3+ metal considered to be an acceptor dopant and a p-type semiconductor, or arsenic antimony, a 5+ metal considered to be donor dopant and an n-type semiconductor, are added as impurities to gallium arsenide, electron movement similar to those achieved in the present invention are realized based upon the oxygen deficient compound gaining electrons from the fully oxidized compound.

The amounts of the oxygen deficient compounds and the fully oxidized compounds can vary depending upon a number of factors and circumstances, allowing the designer to predetermine those amounts and proportions that are most suitable for a particular application, however, this invention provides for a predetermined ratio of fully oxidized compound to oxygen deficient compound to said so that the fully oxidized compound has, during emission, an atomic ratio in the order of 1 part per 1,000,000 as compared to the oxygen deficient compound. As described above, this atomic ratio represents an order of magnitude within which the desired reactions occur since experience with doping levels in other semiconductor applications indicates that excessive amounts of an oxygen deficient compound higher than 1 part per 1,000,000 will upset crystalline lattice structure that impede the electron flow needed for thermionic emissions to occur. Similarly, it has also been experienced that adding too little of the oxygen deficient dopant causes reduced electron flow, making the cathode an insulator. Since this atomic ratio provides a useful order of magnitude, it is not intended to limit the scope of this disclosure and the appended claims as far as employing other ratios is concerned.

Examples of combining the fully oxidized compounds with the oxygen deficient compounds, using the predetermined atomic ratio of 1 part per 1,000,000, along with a number of active emissive metals and metal oxides to attain the desired electron transfer reactions and resulting thermionic emissions in connection with the cathodes and methods of the present invention are illustrated below. These examples are considered illustrative and are not intended to otherwise limit the scope of this disclosure and the appended claims.

EXAMPLE 1

Figure 2:
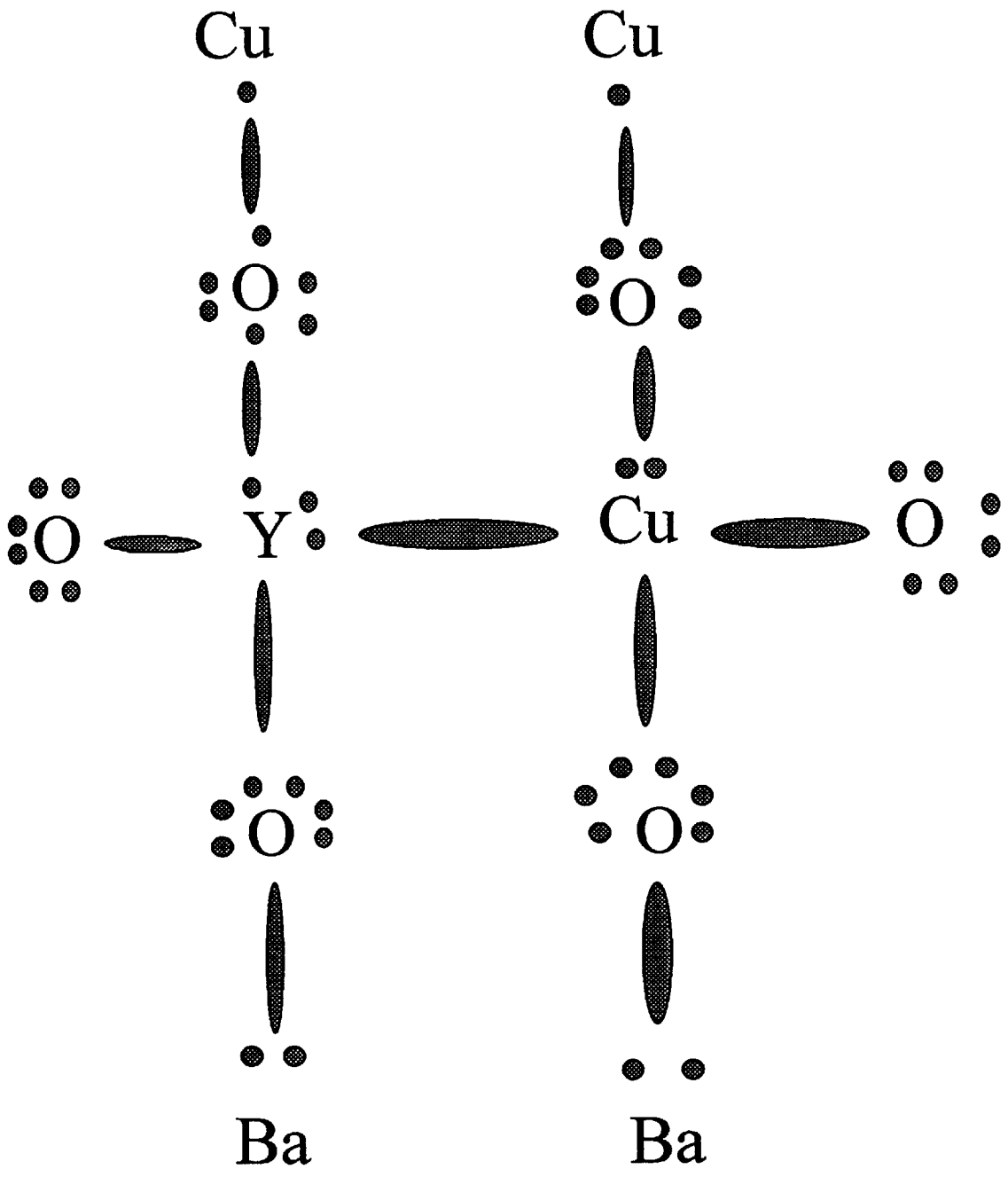
FIG. 2 depicts the chemical structure of $WO_3$ in a chemical structure diagram.

The example below illustrates the use of intermediate compounds that are formed on the surface and interior of the cathode during operation. Use of intermediates such as $WO_3$, $Al_2O_3$ and alloys such as $Al_{13}Ba_7$ to initiate the chemical reaction at temperatures lower than that when only the impregnant such as $Ba_3Al_2O_6$ is present. FIG. 2 is a chemical structure diagram of $WO_3$, which is utilized in a significant way this example.

$Ba_3Al_2O_6$, $WO_3$, $Al_2O_3$, and $Al_{13}Ba_7$ alloy are mixed in such a way that the molar combinations are 2 mole $Ba_3Al_2O_6$, 1 mole $WO_3$, 1 mole $Al_2O_3$ and 0.05 to 0.20 moles of $Al_{13}Ba_7$. This mixture is crushed and then ball milled for two hours. Twenty to forty milligrams of the above molar mixture is mixed with 200 to 300 mgs of tungsten powder. The mixture is ball milled and placed into an isostatic compressor with 60,000 lb/in$^2$ into a billet. X-ray and Auger Spectroscopy tests are run on the billet to determine the distribution of the powder mixture throughout the billet. Sintering the billet at 700° C. for 10 minutes in hydrogen, vacuum or inert gas such as argon prepares the billet for a cathode environment.

In Example 1, said $Ba_3Al_2O_6$, $WO_3$ and $Al_2O_3$ being fully oxidized compounds and said $Al_{13}Ba_7$ being the oxygen deficient compound combined according to the predetermined atomic ratio of 1 part per 1,000,000 providing the necessary electron transfer to produce the desired thermionic emissions in accordance with the cathodes and methods of the present invention.

EXAMPLE 2

Figure 3:
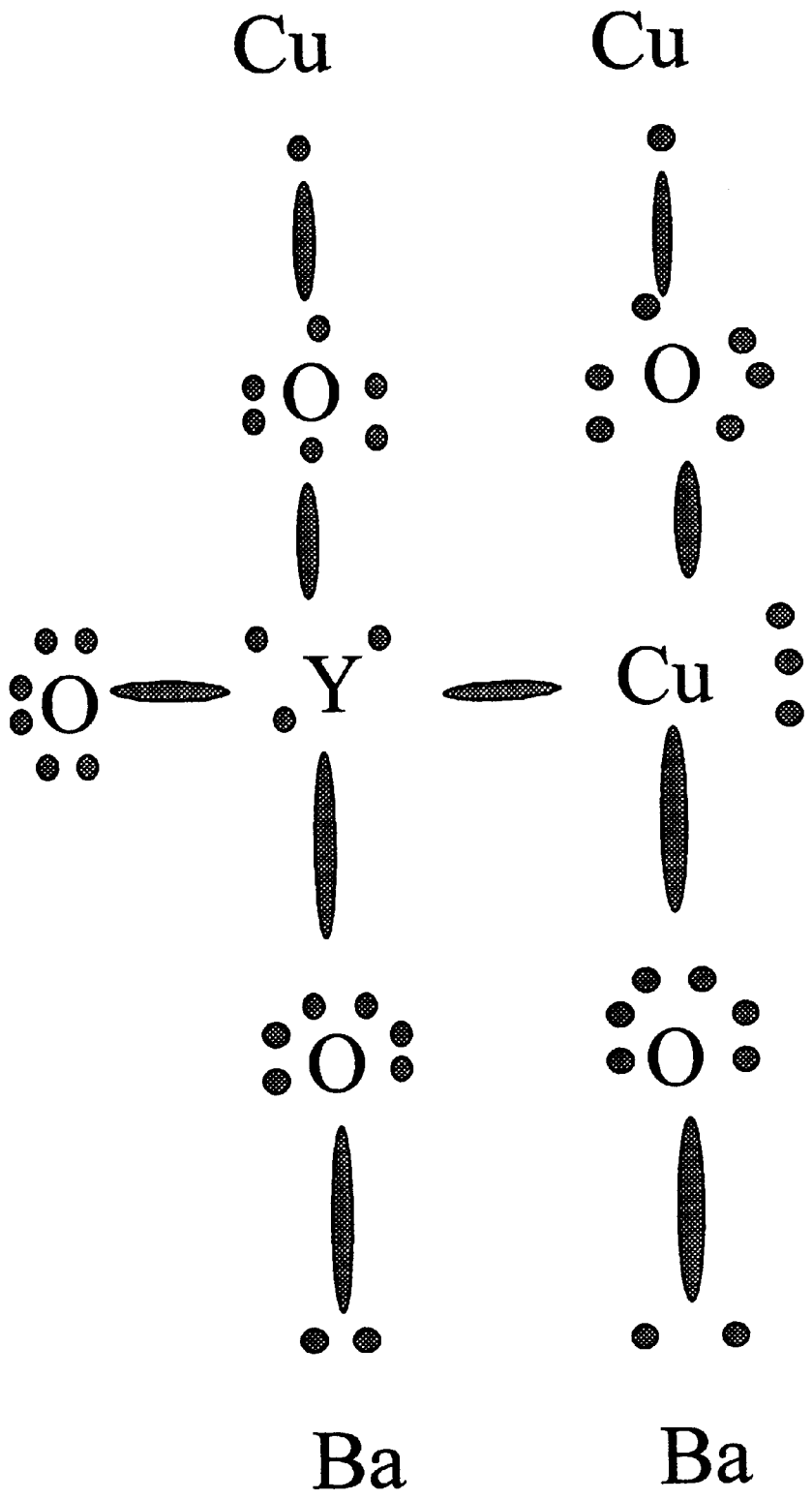
FIG. 3 is a chemical structure diagram of $WO_2$, tungsten oxide.

Another example illustrated below uses an impregnant, $Ba_3Al_2O_6$, with oxygen deficient compounds, such as $WO_2$ and $AlWO_4$. FIG. 3 is a chemical structure diagram of $WO_2$, tungsten oxide, which is utilized in this example.

$Ba_3Al_{26}$, $WO_2$, $AlWO_4$ and an alloy of aluminum and barium such as $Al_{13}Ba_7$ are mixed in such a way that the molar combination is 2 moles $Ba_3Al_2O_6$, 1 mole $WO_2$ 1 mole $AlWO_4$ and 0.05 to 0.2 mole $Al_{13}Ba_7$. The mixture is ball milled for two hours and then a mixture of 200 to 300 mg of tungsten powder is mixed with 20 to 40 mg of the above molar combination of $Ba_3Al_2O_6$, $WO_2$, $AlWO_4$ and $Al_{13}Ba_7$. The mixture is isostatically compacted into a billet, and X-ray and Auger Spectroscopy test are done to determine the distribution of the powders through the billet. Sintering at 700° C. in $H_2$, vacuum, or an inert gas such as argon for 10 minutes prepares the billet for a cathode environment.

As those skilled in the art will realize from this disclosure, impregnants such as $Ba_2Sc_2O_6$, $Ba_2Y_2O_5$, or $Gd_2Ir_2O_7$ would also enhance the production of oxygen deficient materials in the presence of a metal such as W, Mo, or U.

In Example 2, said $Ba_3Al_2O_6$, $Ba_2Sc_2O_6$, $Ba_2Y_2O_5$ and $Gd_2Ir_2O_7$ being the fully oxidized compounds and said $WO_2$, $AlWO_4$ and $Al_{13}Ba_7$ being the oxygen deficient compounds combined according to the predetermined atomic ratio of 1 part per 1,000,000 providing the necessary electron transfer to produce the desired thermionic emissions in accordance with the cathodes and methods of the present invention.

EXAMPLE 3

Other mixtures for impregnation would include mixtures of $Ba_3Al_2O_6$ and $Al_2(WO_4)_3$ in molar concentrations of 1 mole $Ba_3Al_2O_6$ and 1 mole of $Al_2(WO_4)_3$ with 0.05 to 0.1 mole $A_{13}Ba_7$.

Sintering, mixing, and compacting of the above powder with W powder are similar to EXAMPLES 1 and 2.

In Example 3, said $Ba_3Al_2O_6$ and $Al_2(WO_4)_3$ being fully oxidized compounds and said $Al_{13}Ba_7$ being an oxygen deficient compound combined according to the predetermined atomic ratio of 1 part per 1,000,000 providing the necessary electron transfer to produce the desired thermionic emissions in accordance with the cathodes and methods of the present invention.

EXAMPLE 4

The use of intermediates with barium scandates, and scandium intermediates can also be used as in a cathode impregnant.

Illustrations Are:

a. $Ba_2Sc_2O_5$ with $WO_3$, $Sc_2O_3$ such that the molar concentration is 2 moles $Ba_2Sc_2O_5$ with 1 mole $WO_3$ and 1 mole of $Sc_2O_3$.

b. The $Ba_6Sc_6O_{15}/WO_3$ and $Sc_2O_3$ such that the molar concentration is 2 moles $Ba_6Sc_6O_{15}$, 2 moles $WO_3$, and 0.1 to 0.3 mole of $Sc_2O_3$.

c. The $Ba_3Sc_4O_9$ with $WO_3$ and $Sc_2O_3$ such that the molar concentration is 2 moles $Ba_3Sc_4O_9$ 1 mole $WO_3$ and 0.1 to 0.2 mole of $Sc_2O_3$.

Sintering, mixing and compacting of the above powder with W powder are similar to examples 1 and 2 above. In Example 4, said $Ba_2Sc_2O_5$, $WO_3$, $Sc_2O_3$, $Ba_6Sc_6O_{15}/WO_3$ and $Ba_3Sc_4O_9$ being fully oxidized compounds, which when combined with the other constituent components of the present invention according to the predetermined atomic ratio of 1 part per 1,000,000 provides the necessary electron transfer to produce the desired thermionic emissions in accordance with the cathodes and methods of the present invention.

EXAMPLE 5

The use of oxygen deficient compound such that $WO_2$ and $ScWO_4$ with the barium scandates illustrated in example 4 is as follows:

1. $Ba_2Sc_2O_5$ with $WO_2$ and $ScWO_4$ such that the molar combinations are 1 mole $Ba_2Sc_2O_5$, 1 mole $WO_2$ and 1 mole $ScWO_4$.

2. $Ba_6Sc_6O_{15}$ with $WO_2$ and $ScWO_4$ such that the molar concentration is 2 moles $Ba_6Sc_6O_{15}$, 2 moles $WO_2$ and 0.1 to 0.3 mole of $ScWO_4$.

3. $Ba_3Sc_4O_9$ with $WO_2$ and $ScWO_4$ such that the molar combination is 1 mole $Ba_3Sc_4O_9$, 1 mole $WO_2$ and 0.1 to 0.3 mole $ScWO_4$.

4. $BaIrO_3$, $BaTiO_3$ or any Group IV metal with a barium oxide in appropriate molar combination with Ba and $BaWO_4$ (or comparable emissive metals and emissive metal tungstates).

Sintering, mixing and compacting the above powders with W powder are similar to Examples 1 and 2.

Other materials which also could be mixed with an impregnate would include mixing the following: $ScWO_4$, $Ga_2(WO_4)_3$, $GaWO_4$, or $RE(WO_4)_3$ (wherein RE is a rare earth metal) with other oxygen deficient compounds such as $WO_2$ and Ba. Further, metal oxides could also be mixed with the impregnant simply as an additive to achieve the desired ratio. These metal oxides would include any metal with a 3+ valence in the general formulas of $R_2(WO_4)_3$ or $RWO_4$, wherein R=metal 3+, for example, $Al_2(WO_4)_3$ or $Sc_2(WO_4)_3$.

This embodiment would also work with an emissive metal (Ba) or any 3+ metal lanthanate such as Ga or In mixed with, for example $BaCr_2O_4$, $Ba(CrO_4)_2$, $Ba_3Cr_2O_6$, or $BaCrO_4$. Furthermore, other metal compounds could be mixed with the impregnant to achieve the same results. Such compounds would include $BaGa_4$, $Ba_{10}Ga$, $WAl_{12}$, $Al_6W$, W-Ir, and $WOs_2$.

In Example 5, said $WO_2$, $ScWO_4$, Ba and $BaWO_4$ being oxygen deficient compounds, while all other compounds are fully oxidized compounds, which when combined according to the predetermined atomic ratio of 1 part per 1,000,000 providing the necessary electron transfer to produce the desired thermionic emissions in accordance with the cathodes and methods of the present invention.

EXAMPLE 6

This example involves all the mixtures found in Examples 1 through 5 but adding the mixtures to a tungsten cup of known volume and geometric size. Instead of isostatic compacting, the mixtures can be solidified by CVD reactions of W from $W(CO)_6$ and aluminum melting. The intermediate 0.05 mole $Al_2(WO_4)_3$, 0.5 mole $Al_{13}Ba_7$ and 1 mole W with 1 mole $Ba_3Al_2O_6$.

In Example 6, said $W(CO)_6$, $Al_2(WO_4)_3$ and $Ba_3Al_2O_6$ being fully oxidized compounds and said W and $Al_{13}Ba_7$ being oxygen deficient compounds combined according to the predetermined atomic ratio of 1 part per 1,000,000 providing the necessary electron transfer to produce the desired thermionic emissions in accordance with the cathodes and methods of the present invention.

EXAMPLE 7

A top layering (emissive surface) or coating could be provided to the billet to ensure that a sufficient ratio of materials is achieved at the emissive surface. Such layerings would include any of the oxygen deficient compounds or related compounds using other IVa elements; or the layering would include a metal such as Ir, Os, Ru, Rh, Ba; or the layering would include a metal compound such as $Y_2WO_6$.

Because a top layering emission includes two separate electron generators, the impregnated billet itself and the top layered material, the current density will be a sum of both generators. Both Ba and BaO that are generated in the billet below the top layered billet migrate to the layered top to form intermediates and oxygen deficient compounds similar to those produced in the porous billet. The Ba and BaO that usually escapes from the billet is now used by the top layered portion of this billet.

Therefore, to initiate top-layering reactions, formation of compounds such as $Sc_2(WO_4)_3$, or their presence initially in or on a portion of the top layer must be present. Also present must be W such that $Sc_2(WO_4)_3+W \rightarrow 2ScWO_4+2WO_2$. Both products are oxygen deficient and in the presence of Ba and BaO react to form fully oxidized compounds and electrons.

Scandium metal, for example, that can be generated when Ba reacts with $Sc_2(WO_4)_3$ can participate in the reaction by reacting with $Sc_2(WO_4)_3$ to form $ScWO_4$, an oxygen deficient compound.

Oxygen deficient compounds such as $ScWO_4$ and $WO_2$ must be present initially or must be formed for emission to occur. Some preparation of top-layering could include mixtures of $[Sc_2O_3/WO_3/W]$, $[Sc_2(WO_4)_3/W]$, $[Sc_2(WO_4)_3/ScWO_4/W/WO_3]$ example. Only mixtures that give oxygen deficient compounds can be considered for top-layering.

Both Ba and BaO must enter the top layering to obtain maximum emission. $AlWO_4$, for example needs Ba, $WO_2$ needs BaO for maximum emission generating electrons.

When oxygen deficient $WO_2$ reacts with 2 BaO, Ba is generated. This makes for better emission because the Ba is generated within the top layer and does not have to be generated within the porous billet. Possibility of a BaO generator at the bottom of an enriched $WO_2$ layer to give high emission can be made.

Al and $WO_3$ mixtures have been demonstrated to give oxygen deficient compounds $AlWO_4$ and $WO_2$. Mixtures of Al and $WO_2$ can be used in top-layering in the presence of tungsten.

In Example 7, said $Y_2WO_6$, $Sc_2(WO_4)_3$, $Sc_2O_3$, $WO_3$ and BaO being fully oxidized compounds and said W, Ir, Os, Ru, Rh, Ba, W, $2ScWO_4$, 2 $WO_2$, $ScWO_4$ and $AlWO_4$ being oxygen deficient compounds combined according to the predetermined atomic ratio of 1 part per 1,000,000 providing the necessary electron transfer to produce the desired thermionic emissions in accordance with the cathodes and methods of the present invention.

EXAMPLE 8

Figure 4:
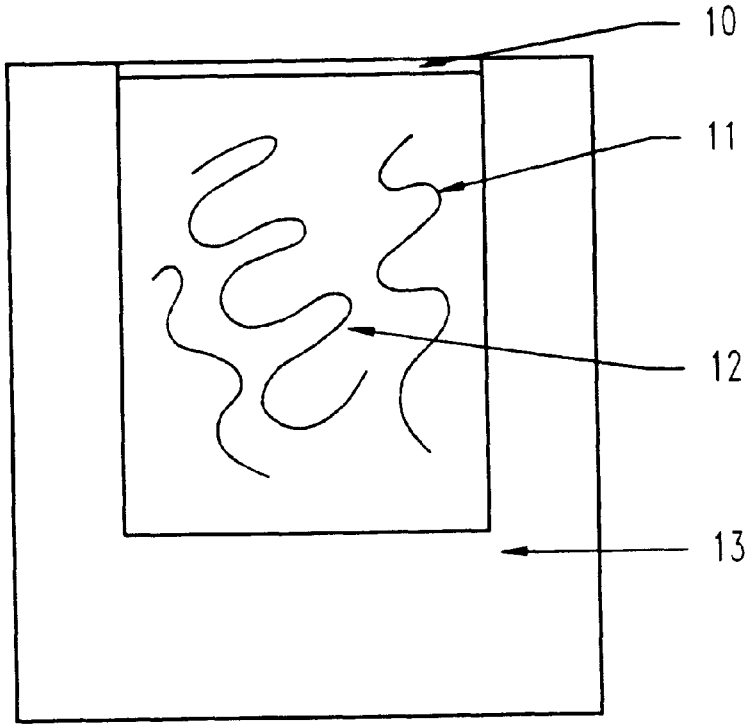
FIG. 4 is a cross-section illustration of one billet and cathode formed of the billet according to the present invention.

Lastly, the oxygen deficient and fully oxidized compounds and the emissive metal could simply be mixed in an appropriate billet. This is shown in FIG. 4 wherein a bored out billet 13 is filled with appropriate molar quantities of oxygen deficient and fully oxidized materials 11 and oxides of a standard billet material such as W or Mo mixed with the same metal (W or Mo) 12 and then a monolayer of an emissive metal alloy 10 such as $Ba_4Al_5$ may be deposited on the surface of the bored out billet 13 and mixture of materials 11 and 12.

Figure 5:
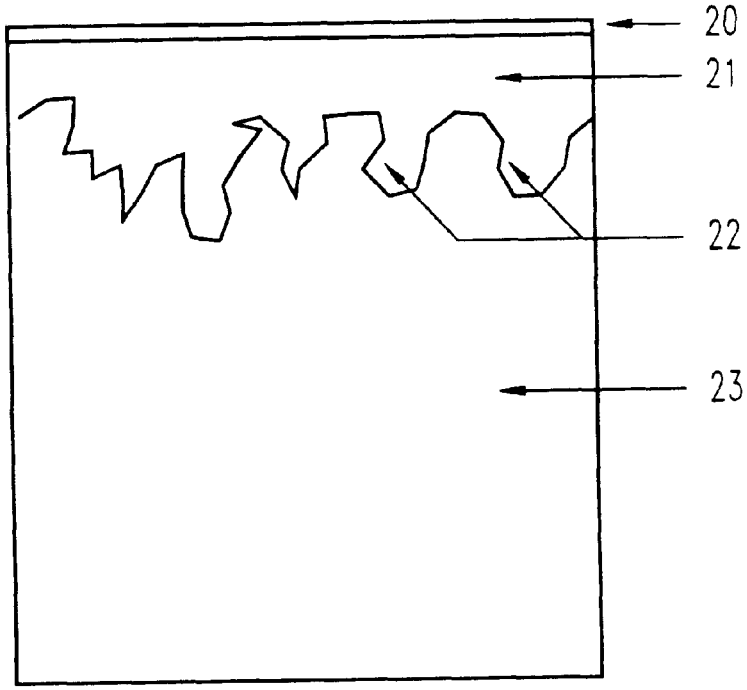
FIG. 5 is a cross-section illustration of another billet and cathode formed of the billet according to the present invention.

Similarly and as shown in FIG. 5, a porous W billet 23 is filled with an impregnant combination of an emissive metal alloy 21, such as $Ba_4Al_5$, and an appropriate combination of oxygen deficient and fully oxidized materials 22. A monolayer of an emissive metal alloy 20 is then deposited over the porous billet and the impregnated billet is then sintered to form a cathode.

Another embodiment is to form the billet of the emissive metal alloy such as BaAl and impregnate this billet with oxides of a metal such as W. The oxides of W($WO_2$ and $WO_3$) are the oxygen deficient and fully oxidized compounds and would react in the same manner as described above.

In Example 8, said W, Mo and $Ba_4Al_5$ being oxygen deficient compounds, which when combined with the other constituent components of the present invention according to the predetermined atomic ratio of 1 part per 1,000,000 provides the necessary electron transfer to produce the desired thermionic emissions in accordance with the cathodes and methods of the present invention.

As shown in all the examples above, the inventive cathode herein requires that the impregnant and/or top emissive layer have a composition wherein the fully oxidized material has, during emission, an atomic ratio on the order of 1 part per 1,000,000 as compared with the oxygen deficient material.

We wish it to be understood that we do not desire to be limited to the exact details of construction shown and described for obvious modifications will occur to a person skilled in the art.

What we claim is:

1. Method of forming a thermionic cathode with an active region comprising the steps of:

forming a porous billet;

impregnating said porous billet with impregnants having a predetermined stoichiometry and in such a quantity such that the active region includes a mixture of at least first and second compounds exhibiting properties of an oxygen deficient material and at least one third compound exhibiting properties of an oxygen sufficient material and an emissive material after sintering said billet and impregnant at a predetermined temperature; and sintering said billet and impregnant at a predetermined temperature.

2. Method according to claim 1 wherein an emissive surface is formed on said active region.

3. Method according to claim 2 wherein said active region is formed using an active metal.

4. Method according to claim 3 wherein said active region is formed with at least one impregnant.

5. Method according to claim 4 wherein a plurality of layers are formed.

6. Method according to claim 5 wherein one of said layers being formed is $Y_2WO_6$.

7. Method according to claim 5 wherein one of said layers being formed is Al and Sc.

8. Method according to claim 5 wherein one of said layers being formed is Ba.

9. Method according to claim 5 wherein one of said layers being formed is selected from the group consisting of Ir, $O_3$, Ru and Rh.

10. Method according to claim 5 wherein one of said layers being formed is Ba in the presence of BaO.

11. Method according to claim 5 wherein one of said layers being formed is $AlWO_4$ and Ba.

12. Method according to claim 1 wherein a plurality of metal oxide additives are added during the impregnating step.

13. Method according to claim 12 said porous billet provides a site for said active region.

14. Method according to claim 13 wherein said impregnant is regenerated.

15. Method according to claim 12 wherein one of said metal oxide additives include $Al_2(WO_4)_3$.

16. Method according to claim 12 wherein one of said metal oxide additives include $Sc_2(WO_4)_3$.

17. Method according to claim 12 wherein one of said metal oxide additives include $R_2(WO_4)_3$ which forms $RWO_4$ when $R=M^{3+}$.

18. Method according to claim 12 wherein one of said metal oxide additives include $BaGa_4$.

19. Method according to claim 12 wherein one of said metal oxide additives include $Ba_{10}Ga$.

20. Method according to claim 12 wherein one of said metal oxide additives include $WAl_{12}$.

21. Method according to claim 12 wherein one of said metal oxide additives include $Al_6W$.

22. Method according to claim 12 wherein one of said metal oxide additives include W-Ir.

23. Method according to claim 12 wherein one of said metal oxide additives include $WOs_2$.

24. A method of making a thermionic cathode having an active region comprising the steps of:

boring a billet;

mixing at least a first compound of a material exhibiting the properties of oxygen deficient compounds, at least a second compound exhibiting the properties of oxygen sufficient compounds, and at least one emissive material within said billet; and sintering said billet.

25. Method according to claim 24 further including the step of mixing active metal oxides and metals in the billet prior to sintering.

26. Method according to claim 25 wherein the second compound is $Ba_3Al_2O_6$.

27. Method according to claim 25 wherein the second compound is a mixture of $BaIrO_3$ and $Ba_2Sc_2O_6$.

28. Method according to claim 1 wherein said impregnants include $BaTiO_3$, Ba, and $BaWO_4$.

29. Method according to claim 1 wherein said impregnants include $Ba_2Y_2O_5$.

30. Method according to claim 1 wherein said impregnants include $BaSc_2O_4$, $BaWO_4$ and Ba.

31. Method according to claim 1 wherein said impregnant includes a compound selected from the group of barium chromates consisting of $BaCr_2O_4$, $Ba(CrO_4)$, $Ba_3Cr_2O_6$, $BaCrO_4$ and $BaCrO_3$ which react to form $Cr_2O_2$.

32. Method according to claim 1 wherein said impregnant includes $Gd_2Ir_2O_7$.

33. Method according to claim 1 wherein said impregnant includes $Al_2(WO_4)_3$ and Ba.

34. Method according to claim 1 wherein said impregnant includes $Al_2(WO_4)_3$ and Sc.

35. Method according to claim 1 wherein said impregnant includes $Al_2WO_4$, $WO_2$ and Ba.

36. Method according to claim 1 wherein said impregnant includes $ScWO_4$, $WO_2$ and Ba.

37. Method according to claim 1 wherein said impregnant includes $ScWO_4$, $WO_2$ and Sc.

38. Method according to claim 1 wherein said impregnant includes $ScWO_4$, $WO_2$ and Ba.

39. Method according to claim 1 wherein said impregnant includes $Ga_2(WO_4)_3$ and Ba.

40. Method according to claim 1 wherein said impregnant includes $Ga_2(WO_4)_3$ and Sc.

41. Method according to claim 1 wherein said impregnant includes $Ga_2WO_4$ and Ba.

42. Method according to claim 1 wherein said impregnant includes $Ga_2WO_4$ and Sc.

43. Method according to claim 1 wherein said impregnant includes $RE(WO_4)_3$ and Ba, wherein RE is a rare earth metal.

44. Method according to claim 1 wherein said impregnant includes $RE(WO_4)_3$ and Sc, wherein RE is a rare earth metal.

45. Method according to claim 1 wherein said porous billet is formed of $MoO_2$.

46. Method according to claim 1 wherein said porous billet is formed of $UO_2$.

47. Method according to claim 1 wherein said porous billet is formed of any combination of $MoO_2$ and $UO_2$.

48. Method according to claim 1 wherein said porous billet is formed of BaAl.

49. Method according to claim 1 wherein said porous billet is formed of W.

50. Method according to claim 1 wherein a top layering of emissive material coats an upper surface of said porous billet said top layering being formed of W mixed directly with BaW, said oxygen deficient material and said oxygen sufficient material.

51. Method according to claim 1 wherein said porous billet is being shaped as a rectangle.

52. Method according to claim 1 wherein said porous billet is being shaped as a disc.

53. Method according to claim 1 further comprising the step of depositing a layer of emission enhancing metal selected from the group consisting of Ir, Os, Ru, Rh and U.

* * * * *